US009677773B2

(12) United States Patent
Fowler et al.

(10) Patent No.: US 9,677,773 B2
(45) Date of Patent: Jun. 13, 2017

(54) BROIL BAFFLE FOR AN OVEN

(71) Applicant: Electrolux Home Products, Inc., Charlotte, NC (US)

(72) Inventors: Warren Fowler, Springfield, TN (US); William Harrison, Springfield, TN (US); Joseph Stull, Bowling Green, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 718 days.

(21) Appl. No.: 14/051,581

(22) Filed: Oct. 11, 2013

(65) Prior Publication Data

US 2015/0101593 A1 Apr. 16, 2015

(51) Int. Cl.

| | |
|---|---|
| ***F24C 15/24*** | (2006.01) |
| ***F24C 3/04*** | (2006.01) |
| *F24C 15/22* | (2006.01) |

(52) U.S. Cl.

CPC ..... *F24C 15/24* (2013.01); *F24C 3/047* (2013.01)

(58) Field of Classification Search

CPC ..... F24C 15/24; F24C 15/166; F24C 15/36; F24C 3/047; F24C 3/045; F24C 3/085; F24C 7/046; F24C 7/043; F24C 15/22; F24C 3/04; F24C 7/04; A47J 37/067; A47J 37/0694

USPC ..... 126/41 R, 14, 152 B, 167; 99/447, 401, 99/446, 444

See application file for complete search history.

(56) References Cited

U.S. PATENT DOCUMENTS 674,991 A * 5/1901 Williams ..... F24F 13/08 126/201
955,411 A * 4/1910 Knauss ..... F24C 3/085 126/39 E
1,516,316 A * 11/1924 Stockstrom ..... F24C 3/047 126/39 E
2,235,886 A * 3/1941 Kahn ..... F24C 3/087 126/1 F
2,244,045 A * 6/1941 Bobo ..... F24C 15/24 126/116 R
2,413,447 A * 12/1946 Greene ..... F24C 15/24 126/41 R
2,415,223 A * 2/1947 Stangle ..... A47J 37/06 126/41 R
2,459,657 A * 1/1949 Klein ..... A47J 37/067 126/41 R
2,477,546 A * 7/1949 Reeves ..... A47J 37/04 126/41 R
2,582,642 A 1/1952 Mayer
2,601,299 A * 6/1952 Kennedy ..... F23D 14/125 126/41 R (Continued)

FOREIGN PATENT DOCUMENTS

CH 602071 A5 * 7/1978 ..... A47J 37/067

*Primary Examiner* — Gregory Huson
*Assistant Examiner* — Daniel E Namay
(74) *Attorney, Agent, or Firm* — Pearne & Gordon, LLP

(57) ABSTRACT

A broil baffle for an oven may be provided. The oven may include a broil burner configured to distribute heat. The baffle may be positioned such that the broil burner distributes heat toward the baffle. The baffle may include a plurality of dimples configured to disperse infrared radiation from the distributed heat in multiple directions away from the baffle toward a broiling surface of the oven.

13 Claims, 2 Drawing Sheets

(56) References Cited

U.S. PATENT DOCUMENTS 2,720,258 A * 10/1955 Brodbeck ..... F23D 14/125 126/41 R
2,723,617 A * 11/1955 Dreyfus ..... A47J 37/0682 126/41 R
2,806,465 A * 9/1957 Hess ..... F24C 3/042 126/299 R
2,867,207 A 1/1959 Fulmer
3,480,000 A * 11/1969 Sloan ..... F24C 14/025 126/21 A
3,529,582 A 9/1970 Hurko
3,638,634 A * 2/1972 Bolitho ..... A47J 37/0682 126/41 R
3,786,230 A * 1/1974 Brandenburg, Jr. .... F24C 7/043 165/49
3,931,805 A * 1/1976 Nelson ..... A47J 37/067 126/25 R
4,077,205 A * 3/1978 Pane ..... F23R 3/08 60/757
4,276,869 A * 7/1981 Kern ..... A47J 37/0713 126/25 R
4,351,313 A * 9/1982 Kern ..... A47J 37/0713 126/39 J
4,403,597 A * 9/1983 Miller ..... A47J 37/0682 126/25 R
4,458,663 A * 7/1984 Kanesaka ..... A01K 31/19 126/116 A
4,629,865 A 12/1986 Freedman et al.
4,773,319 A * 9/1988 Holland ..... A47J 37/0713 126/25 R
4,827,903 A * 5/1989 Kim ..... F24C 15/2042 126/299 D
4,850,335 A * 7/1989 Farnsworth ..... F24C 15/2042 126/21 A
5,038,748 A 8/1991 Lockwood et al.
5,111,803 A * 5/1992 Barker ..... A47J 37/0713 126/41 R
5,313,877 A * 5/1994 Holland ..... A47J 37/0704 126/25 R
5,481,965 A * 1/1996 Kronman ..... A47J 37/0704 126/25 R
6,237,344 B1 * 5/2001 Lee ..... F01D 5/186 165/908
6,283,114 B1 * 9/2001 Giebel ..... A47J 37/0713 126/39 K
6,557,546 B1 5/2003 Gibbons
6,895,953 B2 5/2005 Larsen et al.
7,506,645 B2 * 3/2009 Offredi ..... F23D 14/105 126/39 E
7,997,189 B1 8/2011 Baker et al.
2002/0011244 A1 * 1/2002 Giebel ..... A47J 37/0713 126/41 R
2004/0025862 A1 * 2/2004 Lor ..... A47J 37/0786 126/41 R
2005/0284461 A1 * 12/2005 Hsu ..... A47J 37/0713 126/41 R
2006/0090741 A1 * 5/2006 Bowles ..... F24C 1/04 126/41 R
2006/0118101 A1 * 6/2006 Rhee ..... A47J 37/0786 126/41 R
2009/0178575 A1 * 7/2009 Baker ..... A21B 1/245 99/401
2011/0209694 A1 * 9/2011 Yang ..... F24C 3/087 126/19 R
2011/0226230 A1 9/2011 Reese et al.
2011/0297140 A1 * 12/2011 Baker ..... A21B 1/26 126/41 R
2012/0193337 A1 * 8/2012 Barber ..... F24C 15/22 219/201
2013/0019852 A1 * 1/2013 Yu ..... F24C 15/00 126/19 R
2014/0144424 A1 * 5/2014 Han ..... F24C 15/002 126/41 R
2014/0196712 A1 * 7/2014 Cadima ..... F24C 3/087 126/41 R
2014/0196713 A1 * 7/2014 Cadima ..... F23D 14/045 126/41 R

* cited by examiner

BROIL BAFFLE FOR AN OVEN

BACKGROUND

1. Field

The following description relates to a broil baffle.

2. Description of Related Art

Many conventional ovens possess the ability to cook food objects through a process called broiling. This ability is typically harnessed through the operation of a broil burner within the oven. The broil burner is configured to distribute heat at high temperature throughout the oven by either burning fuel or operation of an electrical element. The walls of the oven serve to direct the distributed heat into contact with food objects within the oven. The contact of the food objects with the distributed heat serves to heat the food objects, which results in the eventual cooking of the food objects.

In some conventional ovens, while a position of food objects within the oven affects the broiling process, in an attempt to direct heat distributed from the broil burner more evenly across all areas of the oven, a baffle may be installed. Typically formed from a sheet of metal, the conventional baffle may inhibit heat distributed from the broil burner from collecting in undesired areas, thereby directing a greater amount of heat to areas of the oven where food objects to be cooked are located. Even in view of the above, additional quickness and evenness of cooking is still desired.

SUMMARY

In one general aspect, a broil baffle for an oven may be provided. The oven may include a broil burner configured to distribute heat. The baffle may be positioned such that the broil burner distributes heat toward the baffle. The baffle may include a plurality of dimples configured to disperse infrared radiation from the distributed heat in multiple directions away from the baffle toward a broiling surface of the oven.

The dimples may be formed in a first side of the baffle facing toward a ceiling of the oven and extend away from the ceiling of the oven and into a second side of the baffle facing the broiling surface of the oven.

The dimples may point toward the broiling surface of the oven.

The first side of the baffle may include a plurality of depressions formed away from the ceiling of the oven. A plurality of protruding peaks may be formed on the second side of the baffle toward the broiling surface of the oven. The protruding peaks may respectively correspond in location to the depressions.

The dimples may include a plurality of first dimples and a plurality of second dimples, the first dimples having a location on the baffle that is closer to the burner than a location of the second dimples, the second dimples having a size that is greater than a size of the first dimples.

The baffle, at the location of the first dimples, may be slanted toward the broil burner.

The baffle, at the location of the second dimples, may occupy a plane that is substantially parallel to the broil burner.

The baffle may be disposed above the broil burner.

The dimples may be configured such that ripples are created in a flame emitted by the burner to disperse the infrared radiation in multiple directions away from the baffle toward the broiling surface.

In another general aspect, an oven may include a broiling surface configured to support food for broiling, a broil burner configured to distribute heat, and a baffle positioned such that the broil burner distributes heat toward the baffle, the baffle including a plurality of dimples configured to disperse infrared radiation from the distributed heat in multiple directions away from the baffle toward the broiling surface to broil the food.

The oven may further include a ceiling disposed above the broiling surface, the burner, and the baffle. The dimples of the baffle may be formed in a first side of the baffle facing toward the ceiling and may extend away from the ceiling and into a second side of the baffle facing the broiling surface.

The dimples of the baffle may point toward the broiling surface of the oven.

The first side of the baffle may include a plurality of depressions formed away from the ceiling. A plurality of protruding peaks may be formed on the second side of the baffle toward the broiling surface. The protruding peaks may respectively correspond in location to the depressions.

The dimples of the baffle may include a plurality of first dimples and a plurality of second dimples, the first dimples having a location on the baffle that is closer to the burner than a location of the second dimples, the second dimples having a size that is greater than a size of the first dimples.

The baffle, at the location of the first dimples, may be slanted toward the broil burner.

The baffle, at the location of the second dimples, may occupy a plane that is substantially parallel to the broil burner.

The baffle may be disposed above the broil burner.

The dimples may be configured such that ripples are created in a flame emitted by the burner to disperse the infrared radiation in multiple directions away from the baffle toward the broiling surface.

Other features and aspects may be apparent from the following detailed description, the drawings, and the claims.

Figure 1:
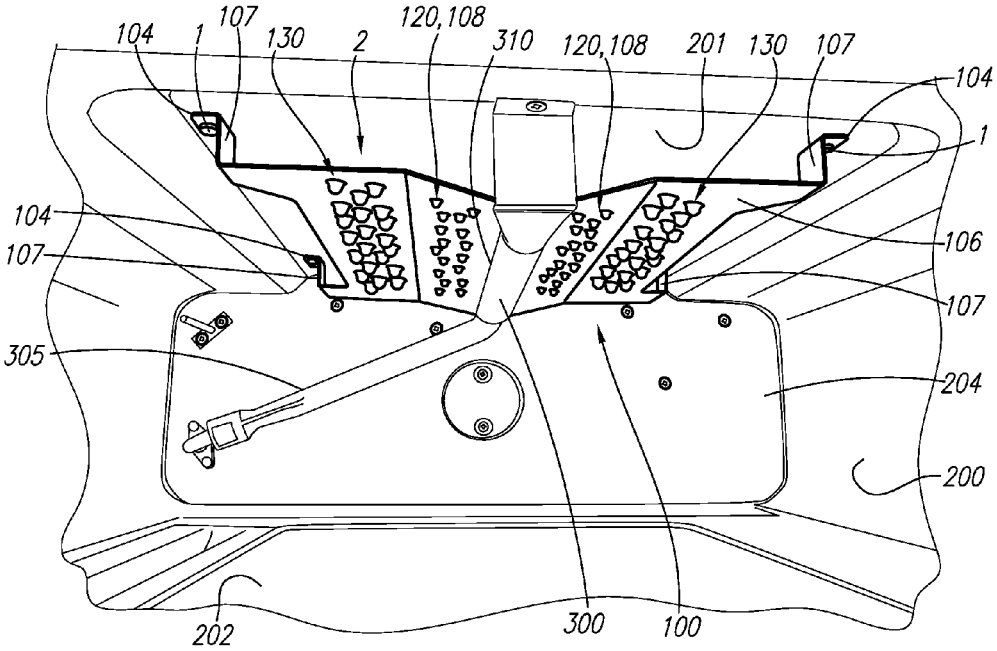
FIG. 1 is a perspective view illustrating an example of an oven including a broil baffle and a broil burner.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Examples incorporating one or more aspects of the present invention are described and illustrated in the drawings. These illustrated examples are not intended to be limiting. For example, one or more aspects of the present invention may be utilized in other embodiments and even other types of devices.

Figure 2:
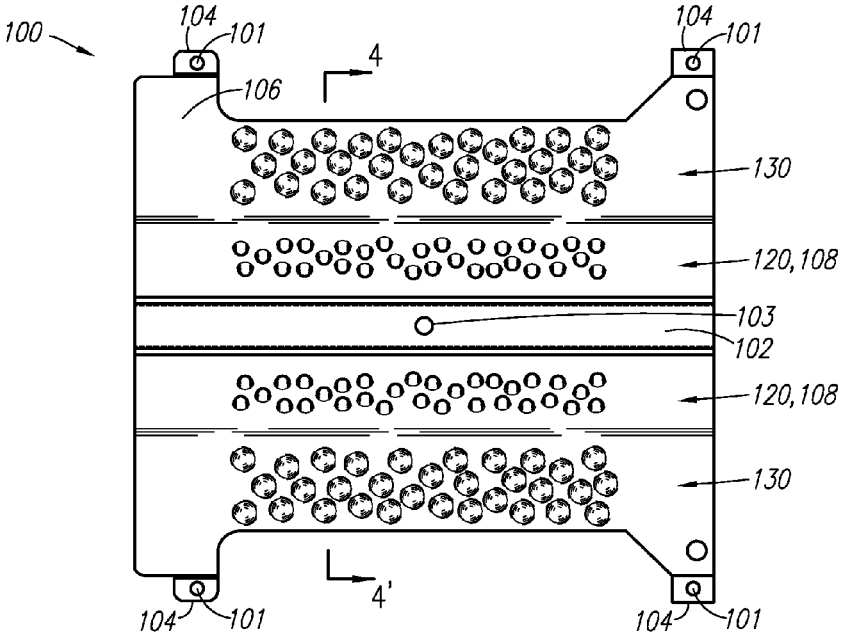
FIG. 2 is a view illustrating an example of a side of the baffle that is exposed to the broil burner.
Figure 3:
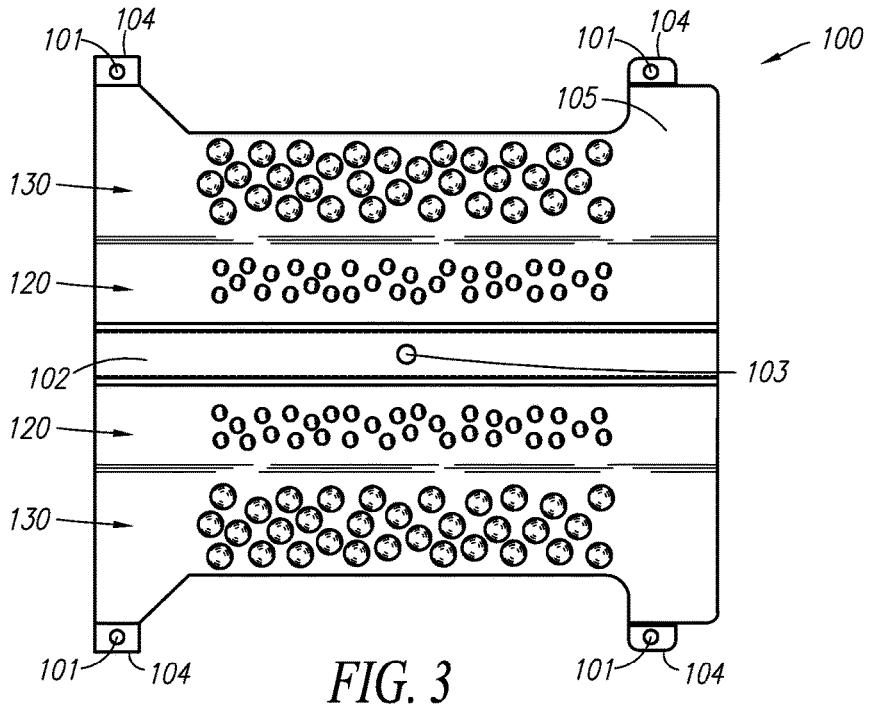
FIG. 3 is a view illustrating an example of a side of the baffle that is not exposed to the broil burner.
Figure 4:
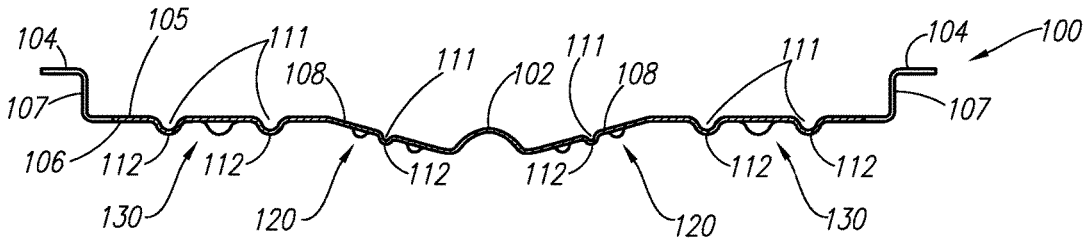
FIG. 4 is a sectional view illustrating an example of the baffle taken along 4-4' in FIG. 2.

FIG. 1 is a perspective view illustrating an example of an oven 200 including a broil baffle 100 and a broil burner 300. FIG. 2 is a view illustrating an example of a side 106 of the baffle 100 that is exposed to the broil burner 300. FIG. 3 is a view illustrating an example of a side 105 of the baffle 100 that is not exposed to the broil burner 300. FIG. 4 is a sectional view illustrating an example of the baffle 100 taken along 4-4' in FIG. 2.

Referring to the examples illustrated in FIGS. 1-4, an oven 200 may include a broil burner 300 disposed adjacent to a ceiling 201 of the oven 200. The burner 300 may be configured to distribute heat from flame ports (not shown) disposed along an upper portion 310 of the burner 300. The flame ports (not shown) disposed at the upper portion 310 of the burner 300 may be located along side portions of the upper portion 310 between the horizontal ends of the burner 300. The upper portion 310 of the burner 300 may be closer to the ceiling 201 of the oven 200 than other portions of the burner 300.

The burner 300 illustrated in FIG. 1 is an example of a cylindrical burner; however, the burner 300 is not limited thereto. One having ordinary skill in the art would understand that the burner 300 could be a flat burner or any other shape of burner, as long as the flame ports (not shown) are disposed along the side portions of the upper portion 310 of the burner 300.

Fuel may be provided to the burner 300 by a conduit 305 at least partially attached to a back wall 204 of the oven 200. The conduit 305 may receive the fuel from an external fuel source and transport the fuel to the burner 300, where it may be distributed throughout the burner 300 to the flame ports (not shown) at a time when the user requests the burner 300 to be lit. While the conduit 305 delivers the fuel to the burner 300 in FIG. 1, one having ordinary skill in the art would understand that the fuel may be delivered to the burner 300 from a different location through the use of a different device.

The flame ports (not shown) may be disposed along the upper portion 310 of the burner 300 such that they distribute heat away from the burner 300 and a bottom surface 202 of the oven 200 in both an upward direction and an outward direction substantially toward the ceiling 201 of the oven 200.

The oven may further include a broil baffle 100 disposed substantially between the burner 300 and the ceiling 201 of the oven 200. The baffle 100 may be mounted to the ceiling 201 of the oven 200. The burner 300 may be disposed underneath the baffle 100 at a central portion 102 thereof and at least partially mounted to the baffle 100 by a fastener (not shown) that passes through a central hole 103 at the central portion 102 of the baffle 100.

The central portion 102 of the baffle 100 may be designed to accommodate or partially receive a burner 300 having a specific shape. For example, in FIG. 1, the burner is illustrated to be 300 cylindrically shaped. In FIG. 4, the central portion 102 of the baffle 100 is illustrated to have a semi-cylindrical shape. Thus, the central portion 102 of the baffle 100 shown in FIG. 4 may partially receive or accommodate the burner 300 shown in FIG. 1. The central portion 102 of the baffle 100 may also serve to divide the baffle 100 horizontally in two outer portions. The central portion 102 of the baffle 100 may separate remaining portions of the baffle 100 into left and right portions. The left portion of the baffle 100 may mirror the right portion of the baffle 100.

While the central portion 102 of the baffle 100 pictured in FIG. 4 has a semi-cylindrical shape, one having ordinary skill in the art would understand that the central portion 102 of the baffle 100, or any other portion of the baffle 100, may be contoured or shaped in such a way as to accommodate or partially receive a shape of the burner 300 in order to dispose the flame ports (not shown) of the burner 300 in an optimal location for operation with the baffle 100.

The baffle 100 may be attached to the oven 200 by way of fasteners 1 that cooperating with holes (not shown) in the ceiling 201 of the oven 200, and mounting holes 101 of the baffle 100. The holes in the ceiling 201 of the oven may be designed to allow the fasteners 1 to be secured thereto. The mounting holes 101 of the baffle 100 may be designed to allow the fasteners 1 to pass partially therethrough in order to secure the baffle 100 to the ceiling 201 of the oven 200.

The mounting holes 101 of the baffle 100 may be provided on feet 104 of the baffle 100 disposed near corner portions of the baffle 100. A front portion of the baffle 100, as it would be installed in the oven 200, may have feet 104 in line with an edge of the front portion, while a rear portion of the baffle 100 may have feet 104 that are displaced slightly to the front from the edge of the rear portion of the baffle 100. The feet 104 may be substantially horizontal portions of the baffle 100.

An interior edge portion of each of the feet 104 may be bent such that a separating portion 107 is formed vertically between the feet 104 and the left or right portions of the baffle 100. The separating portions 107 may be substantially perpendicular to the feet 104 and adjacent portions of the baffle 100. The separating portions 107 may be substantially vertical portions of the baffle 100. The separating portions 107 may provide clearance 2 between the ceiling 201 of the oven 200, and the left, right, and central 102 portions of the baffle 100. However, one having ordinary skill in the art would understand that the baffle 100 may be designed without the separating portions 107 and operated without the clearance 2.

The baffle 100 may be configured to disperse infrared radiation from the distributed heat of the burner 300 toward a bottom surface 202 of the oven 200 on which food is positioned by a user for cooking through exposure to the dispersed infrared radiation. While the oven 200 illustrated in FIG. 1 is an example of a broiler oven of a dual cavity oven unit of a range and has the bottom surface 202 on which food is positioned by the user for cooking, one of ordinary skill in the art would understand that the configuration illustrated in FIG. 1 may be applied to a large, single cavity oven unit of a range devoted to multiple functions, including that of broiling in combination with baking, where a bake element is also active. One of ordinary skill in the art would additionally understand that, in either a single cavity oven unit or the broiler oven of the dual cavity oven unit, a rack positioned close to the ceiling 201 of the oven 200, the burner 300, and the baffle 100 may serve as a surface on which food is positioned by a user for cooking through exposure to the dispersed infrared radiation from the baffle 100.

The baffle 100 may include a plurality of dimples 120, 130 configured to disperse the infrared radiation in multiple directions away from the baffle 100 toward a bottom surface 202 of the oven 200. For example, a contour of the dimples 120, 130, a placement of the dimples 120, 130 on the baffle 100, or a size of the dimples 120, 130 may be configured to provide ripples in flames emitted from the burner 300, thereby serving to disperse infrared radiation from the flames in multiple directions and disturb the infrared radiation such that it is dispersed more quickly and in a greater amount than would be the case without a specific contour, placement, or size of the dimples 120, 130. Therefore, the dimples 120, 130 may enable quicker and more even broiling of food disposed on the bottom surface 202 of the oven 200 than would be the case with a baffle not having the dimples 120, 130.

The dimples 120, 130 of the baffle 100 may be formed in a side 105 of the baffle 100, hereinafter referred to as a top side 105 of the baffle, that, when the baffle 100 is installed and in condition for use, faces the ceiling 201 of the oven 200. The dimples 120, 130 may extend, or project downwardly, away from the ceiling 201 of the oven 200 and into a side 106 of the baffle 100, hereinafter referred to a bottom side 106 of the baffle, that, when the baffle 100 is installed and in condition for use, faces the bottom surface 202 of the oven 200. Further, the dimples 120, 130 may be formed on either side of the central portion 102 of the baffle 100. In other words, the dimples 120, 130 may be formed on the left and right portions of the baffle 100.

As illustrated in FIG. 4, a formation of the dimples 120, 130 may be viewed as depressions 111 formed away from the ceiling 201 of the oven 200 on the top side 105 of the baffle 100 and rounded peaks 112 pointing toward the bottom surface 202 of the oven 200 on the bottom side 106 of the baffle 100. However, the baffle 100 is not limited to this example of the dimples 120, 130. For example, the dimples 120, 130 can be adhered or fastened on the bottom side 106 of the baffle 100 without the formation of depressions 111 in the top side 105 of the baffle 100.

The baffle 100 may include relatively small dimples 120 and relatively large dimples 130. The small dimples 120 may be disposed on portions of the baffle 100 adjacent to the central portion 102 of the baffle 100. The small dimples 120 may be further disposed on slanted portions 108 of the baffle 100 with respect to the feet 104 and portions of the baffle 100 on which the large dimples 130 are disposed. The slanted portions 108 of the baffle 100 may be slanted towards the burner 300 and may be disposed between the central portion 102 of the baffle 100 and the portions of the baffle 100 on which the large dimples 130 are disposed. The slanted portions 108 of the baffle 100 may also be disposed adjacent to a position of the burner 300, as the slanted disposition of the slanted portions 108 of the baffle 100 may serve to lessen an amount of impingement by the flames of the burner 300 that is incurred on the baffle 100, thereby allowing better infrared radiation dispersion than without the slanted portions 108 of the baffle 100.

The large dimples 130 may be disposed on portions of the baffle 100 that occupy a plane that is substantially parallel to the burner 300 and are between the slanted portions 108 of the baffle 100 and the separating portions 107 of the baffle 100. In other words, minor variations may exist in the plane occupied by portions of the baffle 100 on which the large dimples 130 are disposed. Further, the small dimples 120 collected on the slanted portions 108 of the baffle 100 are closer to the burner 300 than the portions on which the large dimples 130 are collected, as the large dimples 130 could be impinged to a greater extent by the flames of the burner 300 than the small dimples 120 if collected on the slanted portions 108, thereby making the slanted portions 108 of the baffle 100 too hot to properly disperse infrared radiation. As a result, the large dimples 130 are desired to be toward outer portions of the baffle 100 between the slanted portions 108 and the separating portions 107, because further impingement by the flames of the burner 300 on the baffle 100 is desired in the outer portions of the baffle 100 between the slanted portions 108 and the separating portions 107.

In FIGS. 1-4, the small dimples 120 and the large dimples 130 are shown disposed on the baffle 100 in a relatively scattered arrangement. The small dimples 120 and the large dimples 130 are also shown to be disposed in respective groups with no commingling of the small dimples 120 with the large dimples 130. However, the arrangement of the dimples 120, 130 is not limited thereto. The dimples 120, 130 may be arranged in any way that would promote optimal dispersion of infrared radiation toward the bottom surface 202 of the oven 200. As a result, the large dimples 130 may be commingled with the small dimples 120 on the slanted portions 108 of the baffle 100. Further, the small dimples 120 may be commingled with the large dimples 130 on the portions of the baffle 100 between the slanted portions 108 and the separating portions 107. In addition, one or more of the small dimples 120 and the large dimples 130 may be patterned in a way that would promote optimal dispersion of infrared radiation toward the bottom surface 202 of the oven 200.

A number of examples have been described above. Nevertheless, it will be understood that various modifications may be made. For example, suitable results may be achieved if the described elements are combined in a different manner and/or replaced or supplemented by other elements or their equivalents. Accordingly, other implementations are within the scope of the following claims.

What is claimed is:

1. A broil baffle for an oven, the oven comprising a ceiling, a broil burner configured to distribute heat, and a broiling surface, the broil baffle being positioned, when in use, such that the broil burner distributes heat toward the broil baffle, the broil baffle comprising:

a first side facing the ceiling;

a second side opposite the first side and facing the broiling surface; and a plurality of dimples, each comprising a depression in the first side and a protruding closed peak on the second side in a location corresponding to the location of the depression, said plurality of dimples being configured to disperse infrared radiation from the distributed heat in multiple directions away from the broil baffle toward the broiling surface.

2. The broil baffle of claim 1, wherein the protruding peaks of said dimples extend away from the ceiling toward the broiling surface.

3. The broil baffle of claim 1, wherein the dimples comprise a plurality of first dimples and a plurality of second dimples, the first dimples having a location on the broil baffle that is closer to the broil burner than a location of the second dimples, the second dimples having a size that is greater than a size of the first dimples.

4. The broil baffle of claim 3, wherein the broil baffle, at the location of the first dimples, is slanted toward the broil burner.

5. The broil baffle of claim 3, wherein the broil baffle, at the location of the second dimples, occupies a plane that is substantially parallel to the broil burner.

6. The broil baffle of claim 1, wherein the broil baffle is disposed above the broil burner.

7. The broil baffle of claim 1, wherein the dimples are configured such that ripples are created in a flame emitted by the broil burner to disperse the infrared radiation in multiple directions away from the broil baffle toward the broiling surface.

8. An oven, comprising: a ceiling a broiling surface configured to support food for broiling;

a broil burner configured to distribute heat; and a baffle positioned such that the broil burner distributes heat toward the baffle, the baffle comprising:

a first side facing the ceiling;

a second side opposite the first side and facing the broiling surface; and a plurality of dimples, each comprising a depression in the first side and a protruding closed peak on the second side in a location corresponding to the location of the depression, said plurality of dimples being configured to disperse infrared radiation from the distributed heat in multiple directions away from the baffle toward the broiling surface to broil the food.

9. The oven of claim 8, further comprising:

the ceiling disposed above the broiling surface, the broil burner, and the baffle, wherein the protruding peaks of said dimples extend away from the ceiling toward the broiling surface.

10. The oven of claim 8, wherein the dimples comprise a plurality of first dimples and a plurality of second dimples, the first dimples having a location on the baffle that is closer to the broil burner than a location of the second dimples, the second dimples having a size that is greater than a size of the first dimples.

11. The oven of claim 10, wherein the baffle, at the location of the first dimples, is slanted toward the broil burner.

12. The oven of claim 10, wherein the baffle, at the location of the second dimples, occupies a plane that is substantially parallel to the broil burner.

13. The oven of claim 8, wherein the dimples are configured such that ripples are created in a flame emitted by the broil burner to disperse the infrared radiation in multiple directions away from the baffle toward the broiling surface.

* * * * *